US009757937B2

(12) United States Patent
Berger et al.

(10) Patent No.: US 9,757,937 B2
(45) Date of Patent: Sep. 12, 2017

(54) SCREEN PRINTING DEVICE FOR APPLYING AN INK

(71) Applicant: SAINT-GOBAIN GLASS FRANCE, Courbevoie (FR)

(72) Inventors: Georg Berger, Langerwehe (DE); Achim Breuer, Herzogenrath (DE); Wolfram Nilles, Uebach-Palenberg (DE); Josef Switalla, Uebach-Palenberg (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 14/409,445

(22) PCT Filed: Jun. 5, 2013

(86) PCT No.: PCT/EP2013/061528
§ 371 (c)(1),
(2) Date: Dec. 18, 2014

(87) PCT Pub. No.: WO2014/012700
PCT Pub. Date: Jan. 23, 2014

(65) Prior Publication Data

US 2015/0191005 A1 Jul. 9, 2015

(30) Foreign Application Priority Data

Jul. 16, 2012 (EP) ..... 12176512

(51) Int. Cl.
*B05C 17/04* (2006.01)
*B41F 15/44* (2006.01)
(Continued)

(52) U.S. Cl.
CPC ..... *B41F 15/44* (2013.01); *B41F 15/0809* (2013.01); *B41M 1/12* (2013.01); *B41M 1/34* (2013.01)

(58) Field of Classification Search
CPC ..... B41L 47/10; B41F 15/44; B41F 31/20; B41F 15/0809; B41F 15/26; B41F 35/004; B41F 15/46
See application file for complete search history.

(56) References Cited

U.S. PATENT DOCUMENTS 5,162,145 A 11/1992 Schaefer
5,273,780 A 12/1993 Borger et al.
(Continued)

FOREIGN PATENT DOCUMENTS

CN 1200079 A 11/1998
CN 1216500 A 5/1999
(Continued)

OTHER PUBLICATIONS

PCT Written Opinion mailed on Jul. 3, 2013 for PCT Application No. PCT/EP2013/061528 filed on Jun. 5, 2013 in the name of Saint-Gobain Glass France—Original German with English translation.

(Continued)

*Primary Examiner* — Matthew G Marini
(74) *Attorney, Agent, or Firm* — Steinfl + Bruno LLP

(57) ABSTRACT

Screen printing device for applying an ink, having at least: a) a conveyor belt, b) a rotating hollow cylindrical screen stencil arranged above the conveyor belt with a circumferential screen and a rotating ink removal cylinder arranged adjacent the screen stencil, wherein: c) inside the screen stencil an ink supply device, a first doctor blade adjacent the conveyor belt, a second doctor blade adjacent the ink removal cylinder, and a third doctor blade, which is arranged
(Continued)

Figure 1:
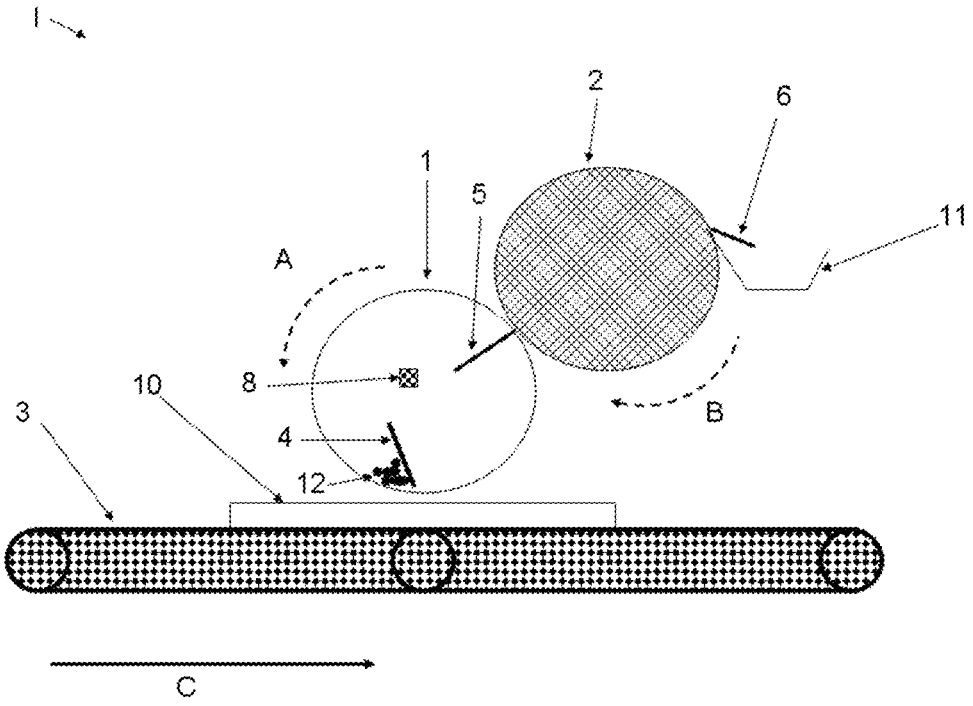
FIG. 1 Prior Art

upstream of the first doctor blade in the running direction of the conveyor belt and/or the rotational direction of the screen stencil are provided.

11 Claims, 4 Drawing Sheets

(51) Int. Cl.

| | |
|---|---|
| ***B41M 1/12*** | (2006.01) |
| ***B41M 1/34*** | (2006.01) |
| ***B41F 15/08*** | (2006.01) |

(56) References Cited

U.S. PATENT DOCUMENTS

| | | | | |
|---|---|---|---|---|
| 5,992,313 | A | 11/1999 | Zimmer | |
| 6,024,015 | A * | 2/2000 | Dillig | B41F 9/061 101/350.5 |
| 2005/0217519 | A1 * | 10/2005 | Naitou | B41L 13/18 101/119 |
| 2007/0012204 | A1 * | 1/2007 | Sato | B41L 23/00 101/118 |

FOREIGN PATENT DOCUMENTS

| | | | |
|---|---|---|---|
| CN | 201249561 | Y | 6/2009 |
| DE | 2247570 | | 4/1973 |
| DE | 4109707 | | 10/1992 |
| DE | 19832414 | | 1/2000 |
| EP | 0974458 | | 1/2000 |
| EP | 1157832 | | 11/2001 |
| EP | 1755893 | | 2/2007 |
| FR | 2156960 | | 6/1973 |
| FR | 2871099 | | 12/2005 |
| GB | 1526213 | | 9/1978 |
| JP | H0380132 | A | 4/1991 |
| JP | 2003191434 | A | 7/2003 |
| WO | 2005123389 | | 12/2005 |

OTHER PUBLICATIONS

International Preliminary Report on Patentability issued on Jan. 20, 2015 for PCT Application No. PCT/EP2013/061528 filed on Jun. 5, 2013.

PCT International Search Report mailed on Jul. 3, 2013 for PCT/EP2013/061528 filed on Jun. 5, 2013 in the name of Saint-Gobain Glass France.

* cited by examiner

SCREEN PRINTING DEVICE FOR APPLYING AN INK

CROSS REFERENCE TO RELATED APPLICATIONS

The present application is the US national stage of International Patent Application PCT/EP2013/061528 filed internationally on Jun. 5, 2013 which, in turn, claims priority to European Patent Application No. 12176512.7 filed on Jul. 16, 2012.

The invention relates to a screen printing device for applying an ink, a method for applying an ink, in particular baking ink, on a pane, and the use thereof.

In screen printing, inks are applied using a rubber squeegee through a screen onto the object to be printed. There are various possibilities for execution of the printing process. In the case of flatbed screen printing, the object to be printed is placed on a flat support, for example, a table. In a next step, the screen stencil is placed on a frame flat on the object. Using a squeegee, the ink is then pressed through the mesh of the screen. When objects are to be printed continuously, the printing can be done via a rotating hollow screen printing cylinder or a screen printing drum. The outer cladding of the drum is formed, in this configuration, at least partially by a printing screen. Upon contact with the surface to be printed, this printing screen transfers the ink using a squeegee situated inside the screen printing drum. The screen printing drum can be used in combination with a conveyor belt for continuous printing of, for example, panes. Ink residues being deposited on or in the mesh can be removed using a second squeegee inside the screen printing drum and, for example, transferred to a cylinder making contact with the screen printing drum. Especially in the case of changing geometries or dimensions of the objects to be printed, ink residues can easily be caught in the meshes of the screen and can, under certain circumstances, accumulate or can, in the worst case, even harden or form clumps. These ink residues can easily result in ghost images or blurred images or patterns.

In particular, in the field of automobile glazing, screen printing has great significance. In the edge region of many different panes, glued points, for example, must be visually concealed. Especially windshields have extensive edge printing that is clearly visible. In addition to the concealing of contact or glued points, the appearance and design of the windshield edge increasingly play a greater role.

An important cost factor in the production of a finished printed motor vehicle window pane is the cycle time and the stability of the process. This also plays a role in the case of printing on the pane edges with a baking ink. Baking inks frequently include contain ink pigments on ceramic glazes or enamel, for example, silicates and oxides. These baking inks are "cured" by heating and form a resistant, chemically stable, and glasslike coating. In many cases, this heating process can also be integrated into the prestressing process. Established processes enable, for example, printing speeds of 3 m to 4 m per minute. However, these printing speeds are frequently not fast enough to enable a process such as production of automotive glazing to be cost-effective. These processes become more cost-effective only at faster cycle times.

DE 2247570 A1 discloses a printer according to the silkscreening method.

GB1,526,213 A discloses a printer for printing cardboard boxes. The printer has a hollow cylindrical structure.

DE 41 09 707 C1 discloses a screen printing method for printing a decorative layer on glass panes. During application of the decorative layer, a printing screen whose surface extends beyond the peripheral surface of the glass pane is used.

DE 198 32 414 A1 discloses a screen printing method for printing on extensive, flat objects, for example, glass panes. The screen printing device includes both a hollow cylindrical screen stencil and an ink removal cylinder.

The object of the invention consists in providing a screen printing device that enables reproducible precise printing of differently dimensioned panes at a high and more rapid rate.

The object of the present invention is accomplished according to the invention by a device according to the independent claim 1. Preferred embodiments emerge from the dependent claims.

A method according to the invention for printing on a pane and use thereof emerge from other independent claims.

The screen printing device according to the invention for applying an ink includes at least a conveyor belt or an assembly line. A rotating hollow cylindrical screen stencil with a circumferential screen and a printing surface is arranged together with an adjacently placed rotating ink removal cylinder above the conveyor belt. In the context of the invention, the term "above" means above the conveyor belt but with pressure contact of the circumferential screen with an object to be printed. In a preferred embodiment, the rotating hollow cylindrical screen stencil and the ink removal cylinder are arranged above the conveyor belt, adjustably with regard to height and length. An ink supply device, for example, a valve connected via lines to an ink supply tank or hoses, is arranged inside the screen stencil. The screen stencil further includes a first doctor blade adjacent the conveyor belt and a second doctor blade adjacent the ink removal cylinder. A third doctor blade is arranged upstream of the first doctor blade in the running direction of the conveyor belt and/or the rotational direction of the screen stencil. In the context of the invention, the term "in the rotational direction" includes a positioning of the third doctor blade upstream of the first doctor blade relative to the running direction of the conveyor belt. The third doctor blade fills the meshes of the circumferential screen with the ink, the first doctor blade presses the ink onto the pane or the substrate to be printed and enables bonding of the ink on the surface of the pane by adhesion. The combination of a third doctor blade and the first doctor blade improves and increases the processing speed of the device according to the invention. The rotating hollow cylindrical screen stencil can the be moved faster with a higher revolution. The pane preferably includes glass panes, particularly preferably glass pane of different sizes or dimensions. Excess ink or ink not used due to the geometry of the pane is transferred by the second doctor blade to the ink removal cylinder. The distance between the screen stencil and the ink removal cylinder is adjusted such that both can rotate independently of each other and, at the same time, the ink residues can be transferred.

Between the third doctor blade and the second doctor blade, a supply channel is preferably arranged. The supply channel enables the transport of excess ink that runs back from the screen inside the screen stencil via the second doctor blade and cannot be transferred to the the ink removal cylinder. The second doctor blade transfers primarily the ink present in the meshes of the screen to the ink removal cylinder. For the most part, the ink situated on the webs of the screen runs back again via the second doctor blade into the interior of the rotating hollow cylindrical screen stencil.

The excess ink arrives again at the third doctor blade via the supply channel and is reintroduced into the screen from there.

The ink removal cylinder preferably includes an ink collection container. The ink collection container gathers the ink collected from the ink removal cylinder. In an optional configuration, the ink collected in the ink removal cylinder can be sent back into the rotating hollow cylindrical screen stencil via hoses.

The ink removal cylinder preferably includes an ink scraper. The ink scraper enables the transfer of the ink situated on the ink removal cylinder into the ink collection container.

The ink supply device preferably includes hoses or nozzles. The ink supply device introduces new ink into the rotating hollow cylindrical screen stencil. The ink supply device can, optionally, also be coupled to the ink collection container and thus reuse ink that has already been used. This ink recirculation reduces production costs.

The screen stencil preferably has a mesh hole diameter from 40 μm to 70 μm. The individual mesh width is governed by the motif to be printed and the composition, viscosity, and wetting of the ink.

The ink preferably contains baking ink. The baking ink can preferably be cured on the pane during the bending operation following the introduction of the ink. Alternatively, a separate heating operation, preferably at 500° C. to 800° C., is also possible.

The invention further includes a method for printing a pane with a screen printing device according to the invention. In a first step, a pane is arranged on a conveyor belt or assembly line. The pane situated on the conveyor belt is printed via a rotating hollow cylindrical screen stencil with a circumferential screen. Simultaneously, inside the hollow cylindrical screen stencil, ink is filled continuously or as needed via an ink supply device. The ink is partially introduced onto the circumferential screen via a third doctor blade. The third doctor blade thus enables a defined pre-filling/filling of the screen with ink. The pane is positioned on the conveyor belt below the rotating hollow cylindrical screen stencil. The ink is applied on the pane via the first doctor blade through the screen. The pre-filling/filling of the screen with ink in the preceding step via the third doctor blade reduces the amount of ink present in the region of the first doctor blade. Relatively large amounts of ink in the region of the first doctor blade often result in clumping or even smearing on the pane to be printed. In the next step, the pane leaves the hollow cylindrical screen stencil on the conveyor belt. The ink remaining inside the screen is transferred via a second doctor blade to an adjacently arranged rotating ink removal cylinder.

The ink situated on the pane is preferably baked. The baking operation improves the stability and durability of the ink.

The pane is preferably prestressed or partially prestressed. The prestressing process of the pane is preferably used for baking the ink. The integration of the baking operation into the prestressing process makes a separate baking process superfluous and the saves processing energy.

The conveyor belt is preferably moved at a speed from 5 m/min to 20 m/min, particularly preferably 10 m/min to 17 m/min, in particular greater than 30 m/min. Compared to the prior art, this speed enables a more cost-effective printing process with significantly higher cycle times.

The hollow cylindrical screen stencil and the ink removal cylinder preferably rotate in opposite directions.

The invention further includes the use of the screen printing device for applying an ink, preferably baking ink.

In the following, the invention is explained in detail with reference to drawings. The drawings are a purely schematic depiction and are not true to scale. They in no way restrict the invention.

Figure 2:
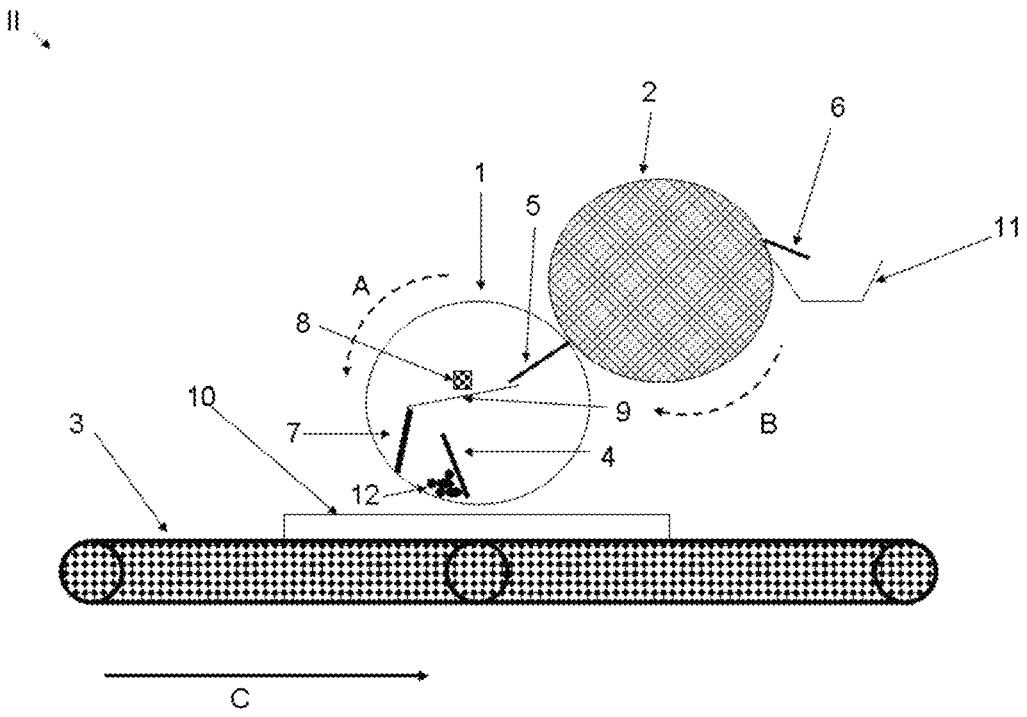
Figure 3:
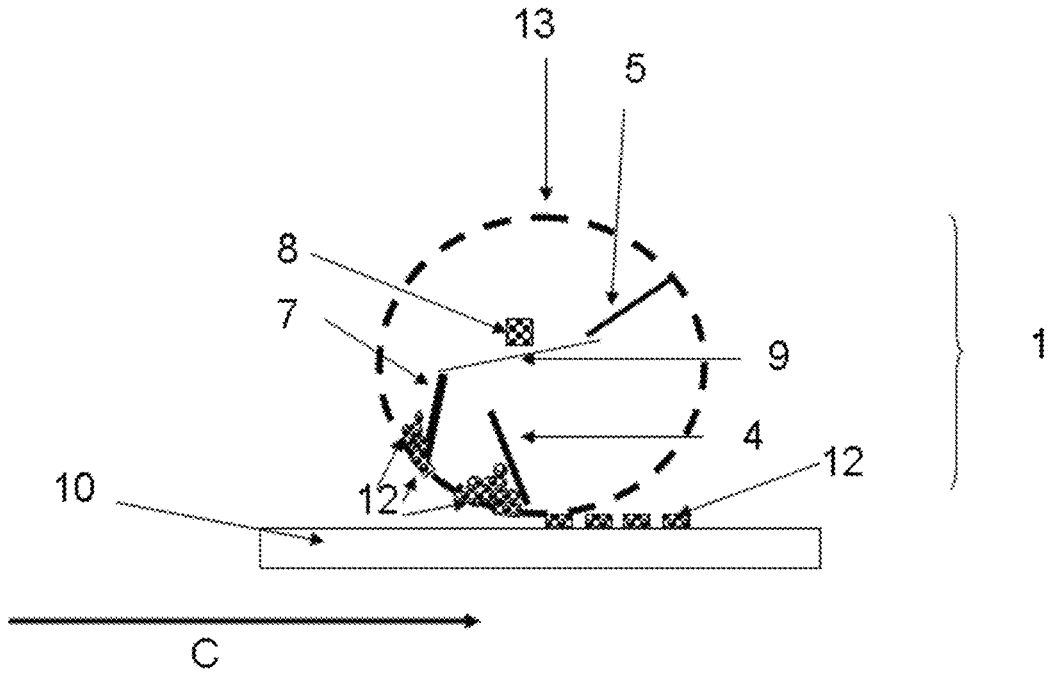
Figure 4:
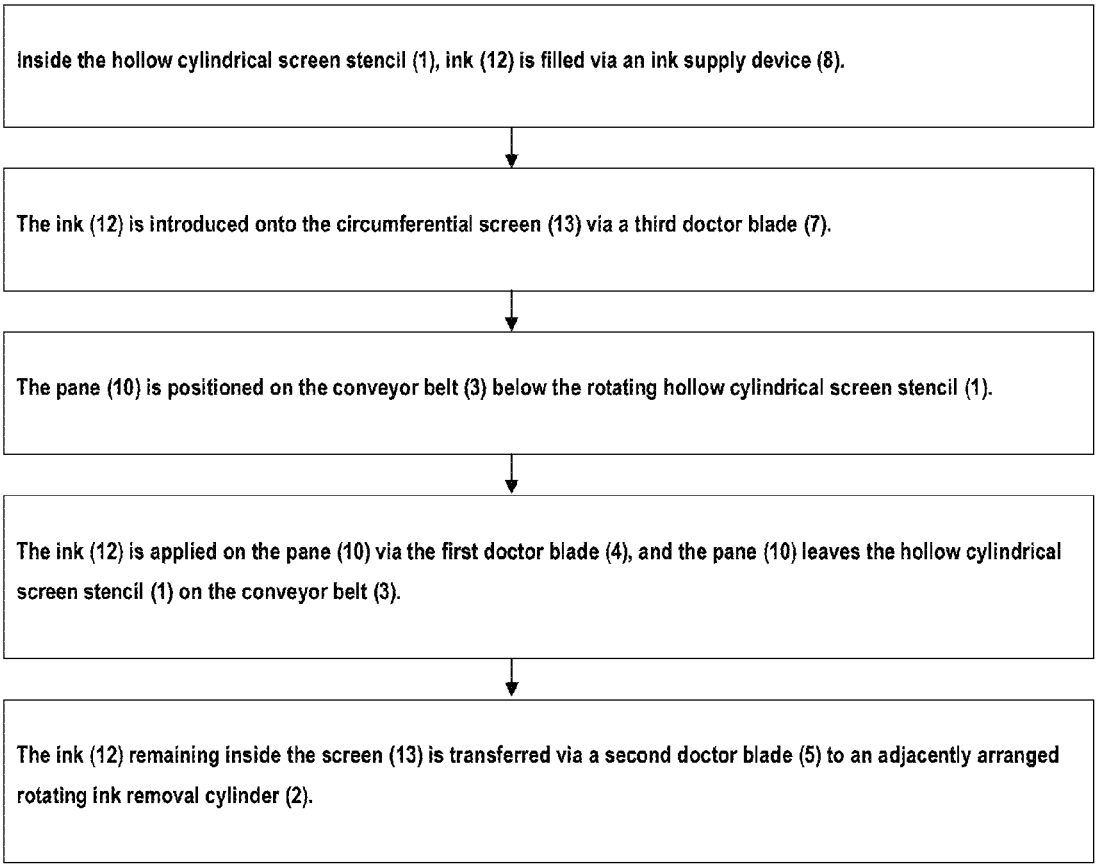

They depict:

FIG. 1 a cross-section of a screen printing device according to the prior art, FIG. 2 a cross-section of the screen printing device according to the invention, FIG. 3 a cross-section of the screen of the rotating hollow cylindrical screen stencil, and FIG. 4 a flowchart of the method according to the invention for printing on a pane.

FIG. 1 depicts a cross-section of a screen printing device (I) according to the prior art. The screen printing device for applying an ink (12) includes at least a conveyor belt (3) or even an assembly line moved in the direction (C). A hollow cylindrical screen stencil (1) rotating in the direction (A) with a circumferential screen (13) (not shown) as a printing surface is arranged together with an adjacently placed ink removal cylinder (3) rotating in the direction (B) above the conveyor belt (3) An ink supply device (8), for example, a valve connected via lines to an ink supply tank or hoses, is arranged inside the screen stencil (1). The screen stencil (1) further includes a first doctor blade (4) adjacent the conveyor belt (3) and a second doctor blade (5) adjacent the ink removal cylinder (2). The first doctor blade (4) fills the meshes of the circumferential screen (13) (not shown) with the ink (12) and presses the ink (12) onto the pane (10) or substrate to be printed and enables bonding of the ink (12) on the surface of the pane (10) by adhesion. The pane (10) preferably includes glass panes, particularly preferably glass panes of different sizes or dimensions. Excess ink or ink not used due to the geometry of the pane (10) is transferred via the second doctor blade (5) to the ink removal cylinder (2). The ink removal cylinder (2) includes an ink collection container (11). Using an ink scraper (6), the ink collection container (11) gathers the ink (12) collected by the ink removal cylinder (2). However, the structure depicted according to the prior art enables only relatively low cycle times during printing. The printing speeds achievable, in other words the running meters of glass that can be printed per minute, are in the range from 3 m to 4 m per minute.

FIG. 2 depicts a cross-section of the screen printing device (II) according to the invention. The basic structure corresponds to that depicted in FIG. 1. The ink (12) is introduced via a third doctor blade (7) partially onto the circumferential screen (13) (not shown). The third doctor blade (7) thus enables a defined pre-filling of the screen (13) with ink (12). The pane (10) is positioned on the conveyor belt (3) below the rotating hollow cylindrical screen stencil (1). The ink (12) is then applied via the first doctor blade (4) through the screen (13) onto the pane (10). A supply channel (9) is arranged between the third doctor blade (7) and the second doctor blade (5). The supply channel (9) enables transporting away excess ink (12) that runs back from the screen (13) via the second doctor blade (5) and cannot be transferred to the ink removal cylinder (2). The second doctor blade (5) transfers primarily the ink (12) present in the meshes of the screen to the ink removal cylinder (2). The ink (12) situated on the webs of the screen (13) runs for the most part via the second doctor blade (5) back into the interior of the rotating hollow cylindrical screen stencil (1). Without the supply channel (9), this ink (12) would accumulate in the region of the first doctor blade (4) and would interfere there with the printing process. In the case of relatively large amounts of ink, this can result in blurring of the printed image. Instead, for the most part, the excess ink arrives via the supply channel (9) back at the third doctor blade (7) and is reintroduced from there into the screen (13). The achievable printing speeds of the device according to the invention fall within the range from at least 15 m to 20 m, preferably greater than 30 m per minute. Consequently, the device according to the invention enables an acceleration of the cycle time by a factor of 3 to 4. The significantly faster cycle time also significantly reduces the costs per printed pane (10).

FIG. 3 depicts a cross-section of the screen (13) of the rotating hollow cylindrical screen stencil (1). The structure corresponds to that depicted in FIG. 2. The third doctor blade (7) enables defined pre-filling of the screen (13) with ink (12) and the first doctor blade (4) enables application of the ink (12) through the screen (13) on the pane (10) moving in the direction (C). The supply channel (9) transports the excess ink (12) back to the third doctor blade (7) and from where it is reintroduced into the screen (13).

FIG. 4 depicts a flowchart of the method according to the invention for printing on a pane (10). In a first step, a pane (10) is arranged on a conveyor belt (3) or assembly-line. Inside the hollow cylindrical screen stencil (1), ink (12) is filled continuously or as needed via an ink supply device (8). The ink (12) is partially introduced onto the circumferential screen (13) via a third doctor blade (7). The pane (10) is positioned on the conveyor belt (3) below the rotating hollow cylindrical screen stencil (1). The ink (12) is applied on the pane (10) via the first doctor blade (4) through the screen (13). The pre-filling/filling of the screen (13) with ink (12) occurring in the preceding step via the third doctor blade (7) reduces the amount of ink present in the region of the first doctor blade (4). These amounts of ink often result in clumping or even smearing on the pane (10) to be printed. In the next step, the pane (10) leaves the hollow cylindrical screen stencil (1) on the conveyor belt (3). The ink (12) remaining inside the screen (13) is transferred via a second doctor blade (5) to an adjacently arranged rotating ink removal cylinder (2).

LIST OF REFERENCE CHARACTERS (A), (B) and (C) running direction
(I) screen printing device according to the prior art
(II) screen printing device according to the invention
(1) rotating hollow cylindrical screen stencil
(2) ink removal cylinder
(3) conveyor belt
(4) first doctor blade
(5) second doctor blade
(6) ink scraper
(7) third doctor blade
(8) ink supply device
(9) supply channel
(10) pane
(11) ink collection container
(12) ink
(13) screen

The invention claimed is:

1. A screen printing device for applying an ink onto a pane, comprising:

a conveyor belt for conveying the pane; and a rotating hollow cylindrical screen stencil arranged above the conveyor belt with a circumferential screen and a rotating ink removal cylinder arranged adjacent the screen stencil, the rotating ink removal cylinder being distanced from the rotating hollow cylindrical screen stencil so that both can rotate independently of each other, wherein inside the screen stencil are an ink supply device, a first doctor blade adjacent the conveyor belt for applying ink on the pane, a second doctor blade adjacent the ink removal cylinder for transferring ink to the ink removal cylinder, and a third doctor blade for filling meshes of the circumferential screen with ink, which is arranged upstream of the first doctor blade in the running direction of the conveyor belt, wherein a supply channel is arranged between the third doctor blade and the second doctor blade for supplying ink from the second doctor blade to the third doctor blade, and wherein the second doctor blade is positioned above the third doctor blade so as to allow flow of ink under gravity through the supply channel.

2. The screen printing device according to claim 1, wherein the ink removal cylinder includes an ink collection container.

3. The screen printing device according to claim 1, wherein the ink removal cylinder includes an ink scraper.

4. The screen printing device according to claim 1, wherein the ink supply device includes hoses or nozzles.

5. The screen printing device according to claim 1, wherein the screen stencil has a mesh hole diameter from 40 μm to 70 μm.

6. The screen printing device according to claim 1, wherein the ink contains baking ink.

7. A method for printing a pane with the screen printing device according to claim 1, wherein a pane on a conveyor belt is printed via a rotating hollow cylindrical screen stencil with a circumferential screen, comprising:

inside the hollow cylindrical screen stencil, ink is filled via an ink supply device, meshes of the circumferential screen are filled with ink via a third doctor blade on the circumferential screen, the pane on the conveyor belt is positioned below the rotating hollow cylindrical screen stencil, ink is applied on the pane via a first doctor blade through the screen, the pane leaves the hollow cylindrical screen stencil on the conveyor belt, the ink remaining inside the screen is transferred via a second doctor blade to an adjacently arranged rotating ink removal cylinder, the rotating ink removal cylinder being distanced from the rotating hollow cylindrical screen stencil so that both can rotate independently of each other, and ink is supplied from the second doctor blade to the third doctor blade via a supply channel, wherein the second doctor blade is positioned above the third doctor blade so as to allow flow of ink under gravity through the supply channel.

8. The method according to claim 7, wherein the ink situated on the pane is baked.

9. The method according to claim 7, wherein the pane is prestressed or partially prestressed.

10. The method according to claim 7, wherein the conveyor belt is moved at a speed from 5 m/min to 20 m/min, preferably 10 m/min to 17 m/min, particularly preferably greater than 30 m/min.

11. The method according to claim 7, wherein the hollow cylindrical screen stencil and the ink removal cylinder rotate in opposite directions.

* * * * *